US008509651B2

(12) United States Patent
Tsukijima

(10) Patent No.: US 8,509,651 B2
(45) Date of Patent: Aug. 13, 2013

(54) IMAGE FORMING APPARATUS

(75) Inventor: Hisashi Tsukijima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 293 days.

(21) Appl. No.: 12/877,314

(22) Filed: Sep. 8, 2010

(65) Prior Publication Data

US 2011/0058825 A1 Mar. 10, 2011

(30) Foreign Application Priority Data

Sep. 9, 2009 (JP) ..... 2009-207865

(51) Int. Cl.
*G03G 15/08* (2006.01)
*H04N 1/04* (2006.01)

(52) U.S. Cl.
USPC ..... 399/114; 399/12; 399/27; 399/111

(58) Field of Classification Search
USPC ..... 399/11–13, 24, 25, 27, 111, 112, 399/114
See application file for complete search history.

(56) References Cited

U.S. PATENT DOCUMENTS 6,091,912 A 7/2000 Kitajima et al.
6,560,416 B2 5/2003 Fischer
7,068,401 B2 * 6/2006 Johnson et al. ..... 358/474
2004/0101321 A1 * 5/2004 Alegria et al. ..... 399/24
2005/0232646 A1 * 10/2005 Yoshizuka et al. ..... 399/27
2006/0002743 A1 * 1/2006 Katsuyama et al. ..... 399/258
2009/0041481 A1 * 2/2009 Iida et al. ..... 399/12

FOREIGN PATENT DOCUMENTS

JP 3-050568 A 3/1991
JP 5-045996 A 2/1993
JP 11-212348 A 8/1999

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes an image forming portion with a plurality of image bearing members and a plurality of developing devices, a plurality of cartridges, a maintenance door allowing access to the image forming portion for a maintenance operation, a plurality of first doors, remainder detecting means for detecting information relating to amounts of the developers in the cartridges, locking means for locking the first doors, a controller, a moving mechanism, and a second door capable of opening and closing to cover the first doors. The first doors open and close respective openings for insertion of the cartridges into the main assembly independently from each other, without access via the maintenance door. The controller controls the locking means to release a locking of a first door corresponding to a cartridge which requires exchange, on the basis of a detection result of the remainder detecting means.

4 Claims, 9 Drawing Sheets

IMAGE FORMING APPARATUS

FIELD OF THE INVENTION AND RELATED ART

The present invention relates to image forming apparatuses, such as a printer, a copy machine, and a facsimile machine, and the like.

A toner supplying apparatus removably connects a toner cartridge, which contains toner, with the image assembly of an image forming apparatus, and delivers the toner from the toner cartridge into the toner hopper of the image forming apparatus. A toner supplying apparatus is employed by image forming apparatuses such as an electrophotographic printer, an electrophotographic copy machine, and an electrophotographic facsimile machine. An electrophotographic image forming apparatus is structured so that a latent image is written on its photosensitive drum with a beam of laser light, and is developed with toner. Thus, the developing device of an electrophotographic image forming apparatus is provided with a toner hopper which temporarily stores the toner to be supplied to the peripheral surface of the photosensitive drum, and also, supplies the developing device with the toner.

As a latent image is developed, the toner within the toner hopper is consumed. Thus, as the toner in the toner hopper is consumed, toner is delivered into the toner hopper from a toner cartridge which is in the image forming apparatus main assembly, and is removably mountable in the main assembly.

Further, as it is detected by a sensor or the like that the amount of the developer in a developer cartridge has reduced to a certain level, a message which prompts a user to replace the toner cartridge is displayed. Further, if the amount of the toner in the toner hopper of the main assembly of the image forming apparatus falls below a preset level, the image forming apparatus stops printing. Thereafter, as soon as the replacement of the toner cartridge in the main assembly of the image forming apparatus makes it possible to supply the toner hopper with toner, the image forming apparatus restores itself so that it can restart the interrupted image forming operation.

Some image forming apparatuses employ multiple toner cartridges. These image forming apparatuses are structured so that as the amount of toner in any of the toner cartridges reduces below a preset level, they display a message that prompts a user to replace the toner cartridge, and also, so that the multiple cartridges can be individually replaced. Generally speaking, it is unlikely for all the cartridges to be replaced at the same time. That is, usually, it is only one of the cartridges that needs to be replaced. However, image forming apparatuses which require a user to perform a cartridge replacement sequence to make them ready for cartridge replacement are problematic in that it is possible for a wrong toner cartridge, that is, a toner cartridge which does not need to be replaced, will be replaced.

Thus, it has been proposed to provide an image forming apparatus with an automatic developing device replacement apparatus, more specifically, an apparatus which automatically selects a proper developing device from among the multiple developing devices in a developing device storing apparatus, and automatically replaces the developing device, which is necessary to be replaced, with the proper replacement cartridge (for example, Japanese Laid-open Patent Application H03-50568). However, the provision of an image forming apparatus with the structural arrangement for moving a process cartridge, a developing device, and a toner cartridge, from the position in which they can function for image formation, to the position into and from which they are to be mounted or dismounted, respectively, leads to an increase in size the main assembly of the image forming apparatus, and also, an increase in the space necessary for the maintenance of the image forming apparatus, and therefore, is not desirable.

Thus, it has been proposed to provide each of the toner cartridge chambers with such a door that automatically opens, as it is unlocked, to inform a user that the corresponding cartridge needs to be replaced. It has also been proposed (disclosed) to provide each toner cartridge with a display so that a user can be given visual information that the cartridge has virtually run out of toner (U.S. Pat. No. 6,560,416).

However, U.S. Pat. No. 6,560,416 suffers from the following problem. That is, in the case of the structural arrangement disclosed in U.S. Pat. No. 6,560,416, the door of the chamber for the toner cartridge necessary to be replaced automatically opens without a request from an operator. Therefore, it is possible for the door to be temporarily left open, which is undesirable.

It is possible to provide an image forming apparatus with a display which offers visual information regarding the toner cartridge, instead of equipping the development cartridge chamber door with a locking means which allows the door, which corresponds to the developer cartridge with virtually no toner, to automatically open, as disclosed in U.S. Pat. No. 6,560,416, to inform a user that the toner cartridge is virtually out of toner.

In the case of this structural arrangement, the door was not provided with a locking means. Therefore, a wrong door was sometimes opened by a user, which resulted in the interruption of the on-going image forming operation. Further, it required an image forming apparatus to be provided with multiple displays, which increases the apparatus in cost. On the other hand, in the case of the structural arrangement which prevents the cost increase by not employing multiple displays, and equips each door with a locking means to prevent the replacement of toner cartridge(s) which does not need to be replaced, a user has to look for the unlocked door, which is a waste of time.

SUMMARY OF THE INVENTION

Thus, the primary object of the present invention is to provide an image forming apparatus which does not have multiple displays which correspond to multiple developer cartridges, one-for-one, and yet, enables an operator to easily find a developer cartridge, in the apparatus, which needs to be replaced, and also, is structured so that it does not occur that a developer cartridge chamber door opens without a confirmation from a user, and therefore, is left open in the state in which the corresponding cartridge is accessible.

According to an aspect of the present invention, there is provided an image forming apparatus comprising a plurality of cartridges for supplying developers, said cartridges being detachably mountable to a main assembly of the apparatus; a plurality of first doors, provided correspondingly to cartridges, respectively, for opening and closing inserting openings for permitting insertion of said cartridges into said main assembly of the apparatus, independently from each other; remaining amount detecting means for detecting information relating to an amount of the developer contained in the cartridges; locking means for locking said first doors; a controller for controlling said locking means, on the basis of a result of detection of said remaining amount detecting means, to unlock only said first door corresponding to the cartridge to be exchanged; a moving mechanism for moving said first door from a position closing to an opening position with the unlocking of said locking means; and a second door movable between a closing position for preventing access to said first doors and an opening position for permitting access to said first doors; opening and closing detecting means for detecting opening and closing of said second door; wherein said controller unlocks said first door on the basis of the results of detection of said opening and closing detecting means and said remaining amount detecting means.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. It should be noted here that the measurements, materials, and shapes of the structural components of the image forming apparatuses in the following embodiments of the present invention, and the positional relationship among them, are not intended to limit the present invention in scope, unless specifically noted.

Figure 1:
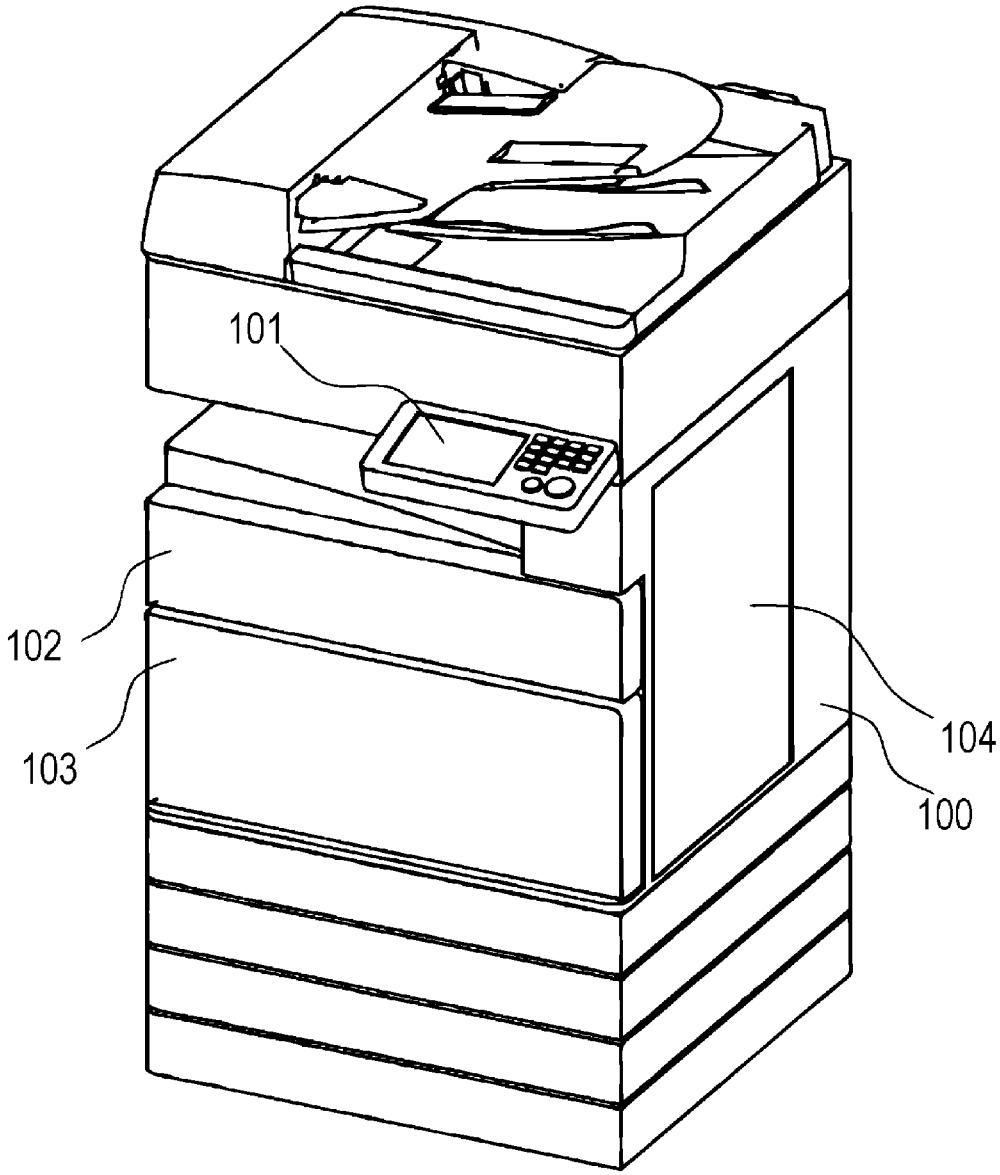
FIG. 1 is a perspective view of the image forming apparatus in the first embodiment of the present invention.
Figure 2:
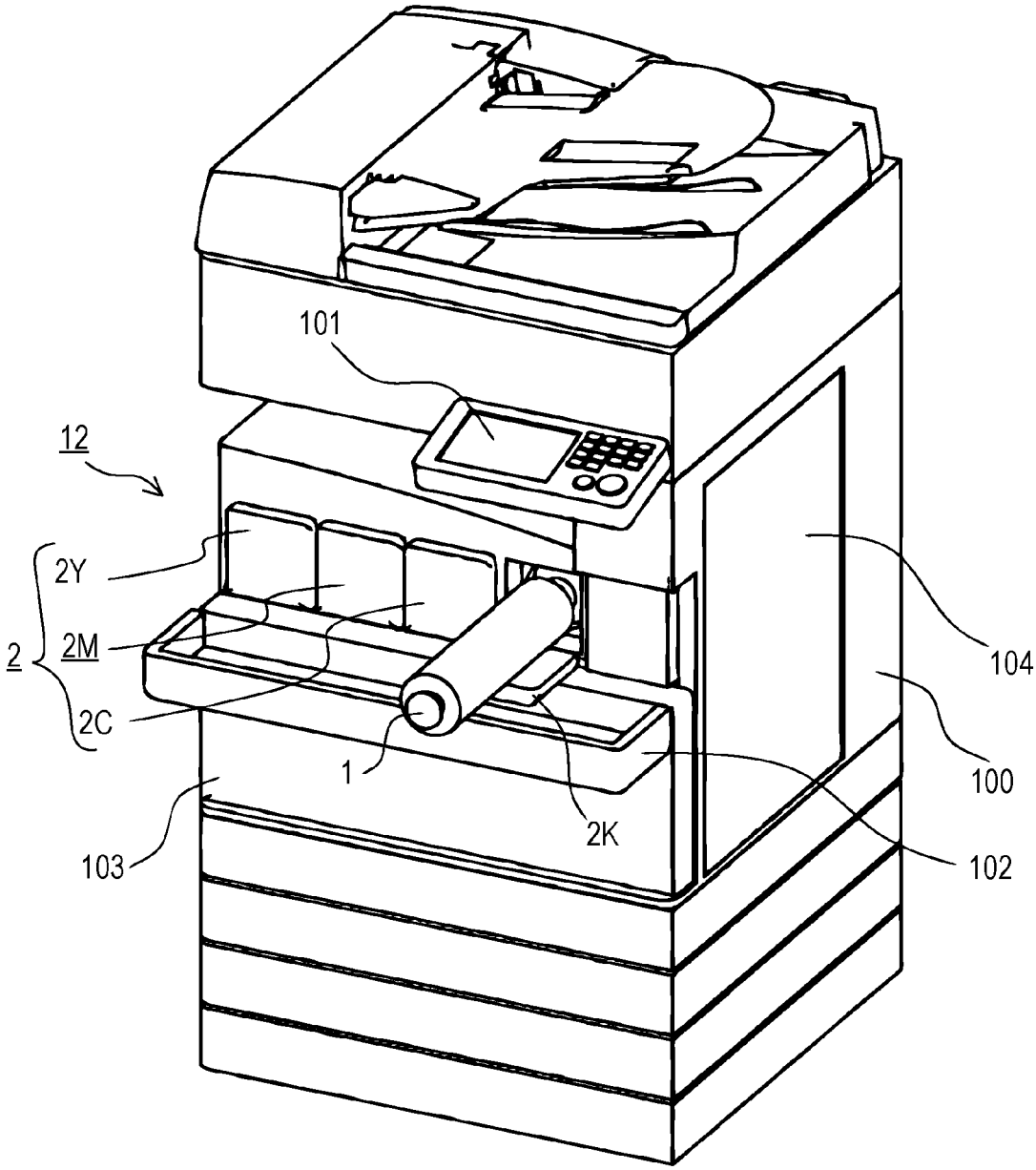
FIG. 2 is a perspective view of the image forming apparatus in the first embodiment of the prevent invention, which is in the state in which the developer cartridge chamber door of the apparatus is open, and a development cartridge is being mounted into the developer cartridge chamber.
Figure 3:
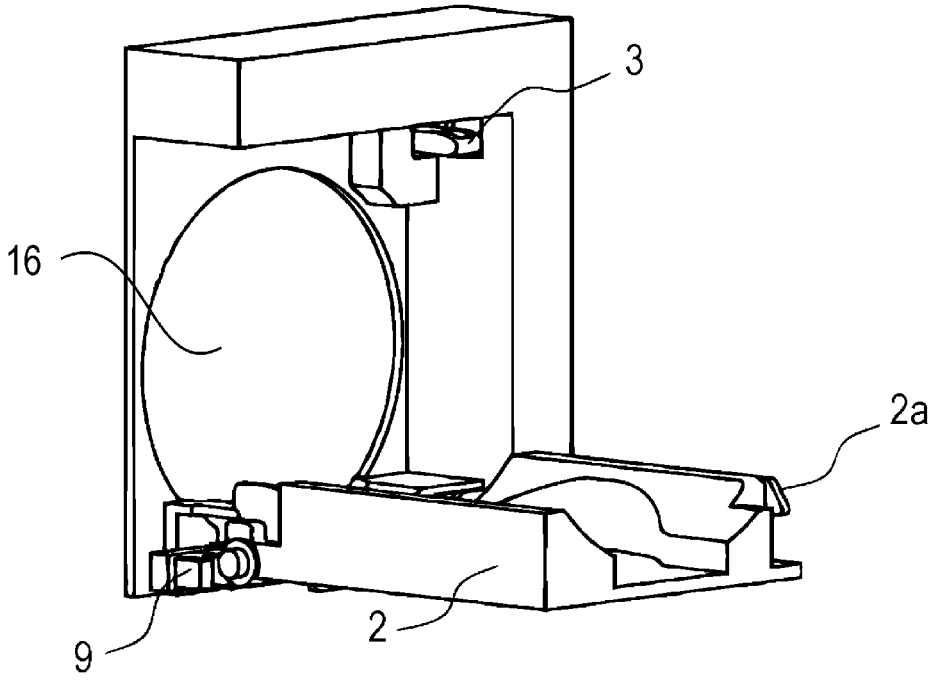
FIG. 3 is a perspective view of the developer cartridge chamber and developer cartridge chamber door of the image forming apparatus in the first embodiment, which are in the state in which the door is fully open.
Figure 4:
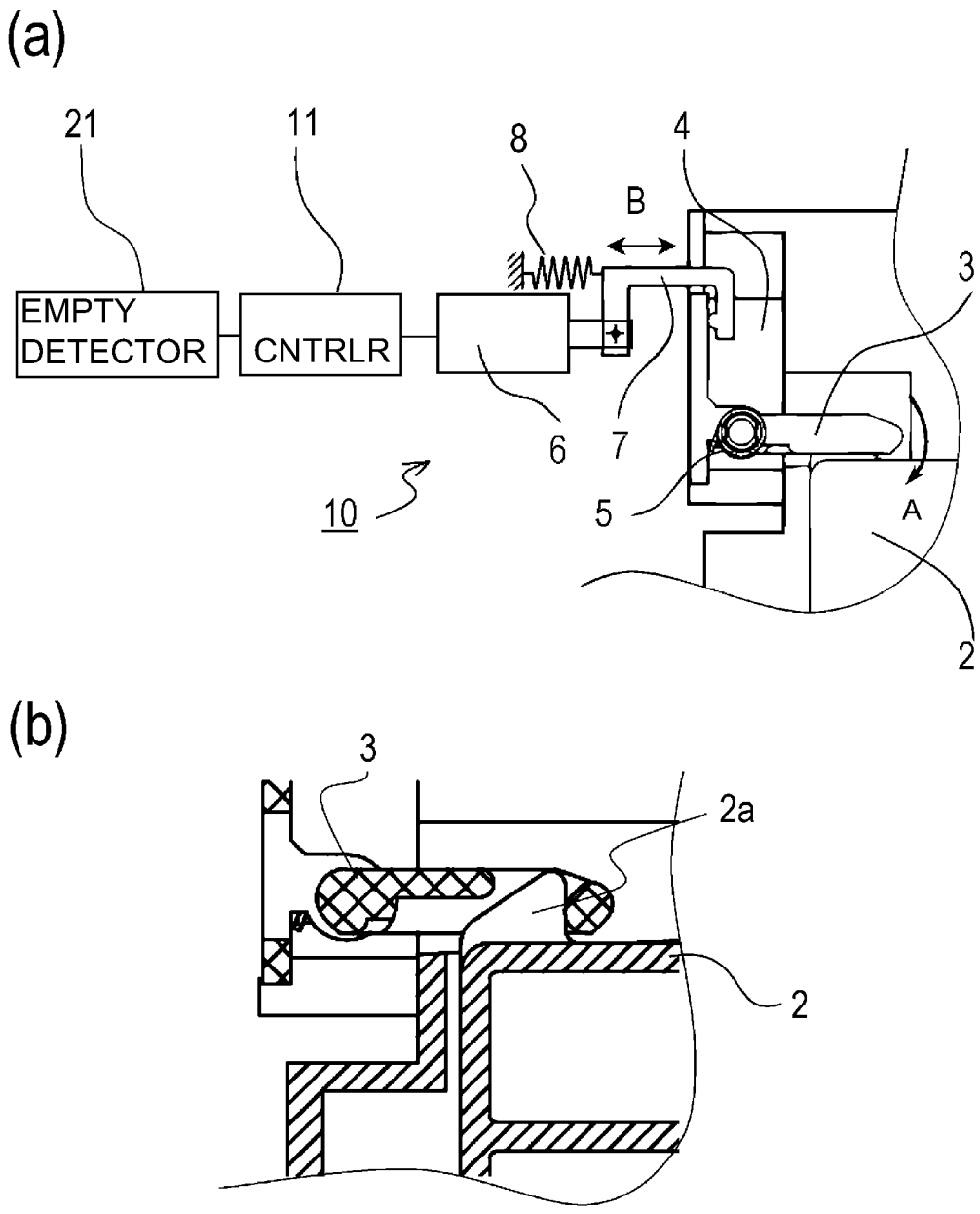
FIG. 4 is a drawing for showing the state of engagement between the developer cartridge chamber door and the apparatus for locking (or unlocking) the door.
Figure 5:
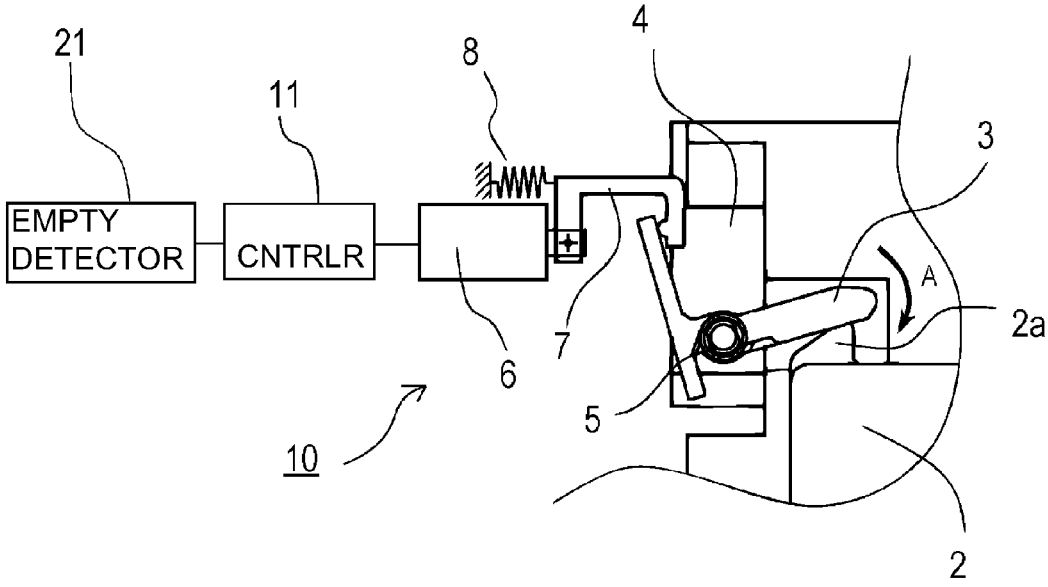
FIG. 5 is a drawing for showing the state of disengagement between the developer cartridge chamber door and the apparatus for locking (or unlocking) the door.

FIG. 1 is a perspective view of the image forming apparatus (which hereafter may be sometimes referred to as "apparatus main assembly") in the first preferred embodiment of the present invention, and depicts the structure of the apparatus. FIG. 2 is a perspective view of the image forming apparatus in the first embodiment of the prevent invention, which is in the state in which the external door 102 and developer cartridge chamber door 2 are open, and a development cartridge is being mounted. FIG. 3 is a perspective view of the developer cartridge chamber and developer cartridge chamber door of the image forming apparatus in the first embodiment, which are in the state in which the door is fully open. FIG. 4 is a drawing for showing the state of engagement between the developer cartridge chamber door 2 and the apparatus for locking (or unlocking) the door 2. FIG. 5 is a drawing for showing the state of disengagement between the developer cartridge chamber door 2 and the apparatus for locking (or unlocking) the door.

Figure 8:
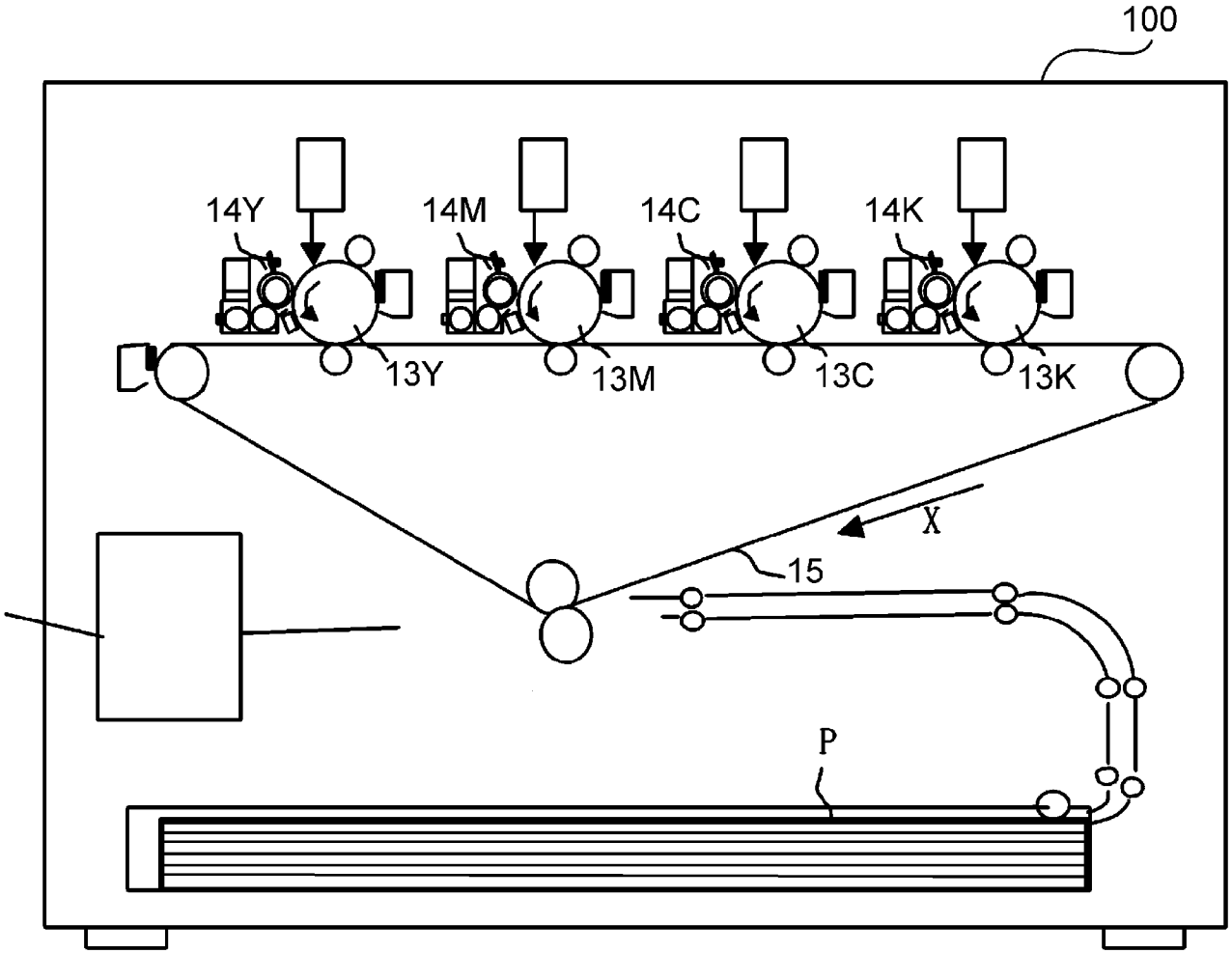
FIG. 8 is a schematic sectional view of a typical electrophotographic image forming apparatus, and shows the structure of the apparatus.

The developer supplying apparatus 12 depicted in FIG. 2 is structured to selectively and removably mount one-by-one the multiple developer cartridges 1, which are full of the developer to be supplied to the main assembly of the developing apparatus 14, into the image forming apparatus main assembly 100. Referring to FIG. 8, the image forming apparatus main assembly 100 forms images with the use of an electrophotographic method. It has four photosensitive drums 13 (13K, 13C, 13M, and 13Y), which are the members on which an electric static latent image is borne. It has also four developing apparatuses 14 (14K, 14C, 14M, and 14Y), which are means for developing the electrostatic latent images on the photosensitive drums 14 into visible images, that is, images formed of toner (which hereafter will be referred to simply as "toner images"), one-for-one. Further, the image forming apparatus main assembly 100 has the developer supplying apparatus 12, a transferring apparatus 15, etc. The developer supplying apparatus 12 supplies the developing apparatuses 14 (developing apparatus main assembly) with developers. The transferring apparatus 15 is a means for transferring the toner images formed by the developing apparatuses 14, onto a sheet P of recording medium.

Figure 6:
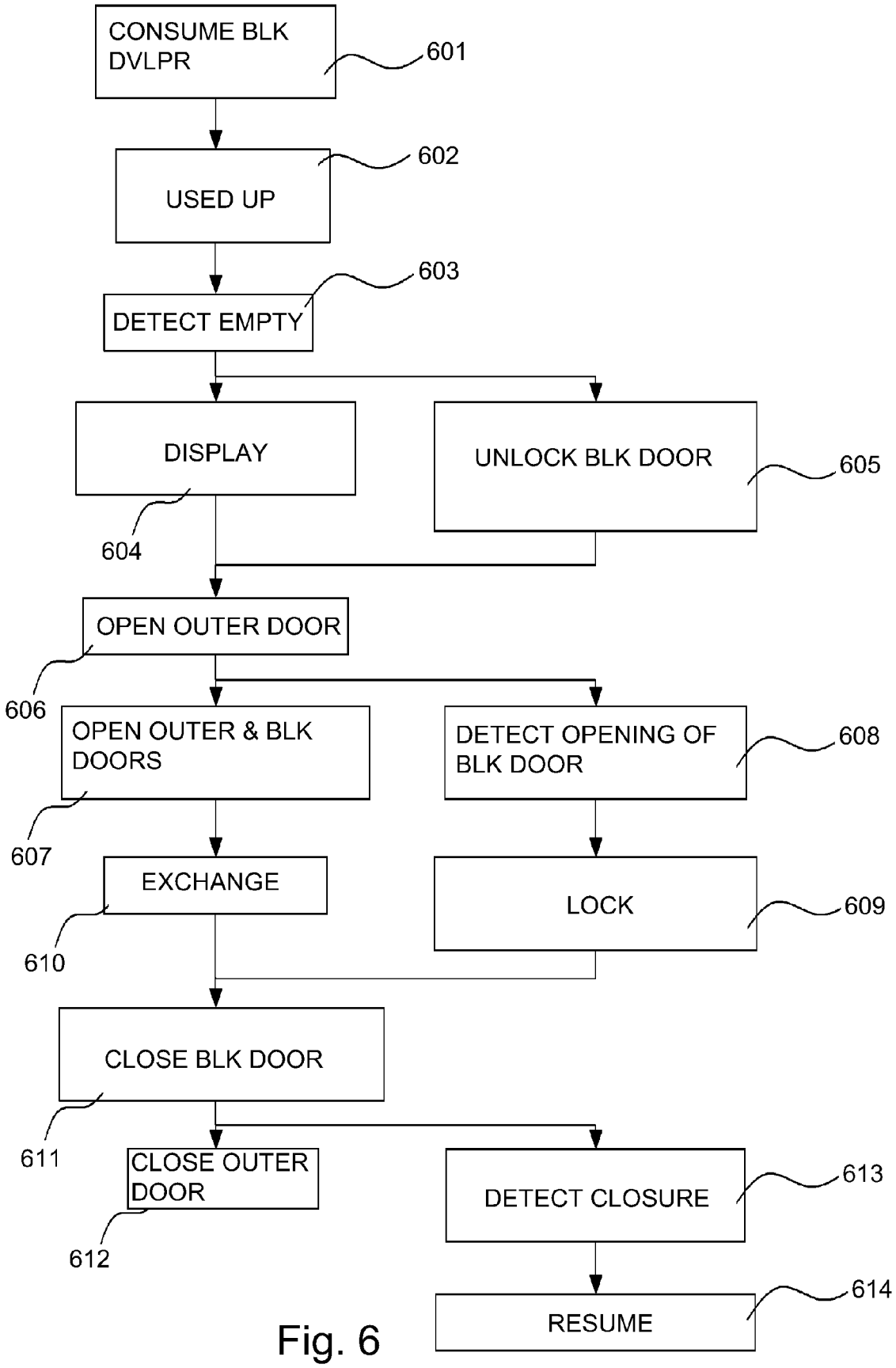
FIG. 6 is a flowchart of the development cartridge replacement sequence.

Next, referring to the flowchart in FIG. 6, the development cartridge replacement sequence carried out by the developer supplying apparatus 12 in this embodiment will be described with reference to the replacement of the black developer cartridge 1. As an image forming process continues (Step 602), the developer in the black developer cartridge 1 is eventually consumed virtually in entirety (Step 602). As the developer in the black developer cartridge 1 in the image forming apparatus main assembly 100 is consumed virtually in entirety, the state of this developer cartridge is detected by a developer amount detecting portion 21, which is a means for detecting the amount of the developer in a developer cartridge; it is detected that the black developer cartridge 1 has run out of developer (Step 603). Then, a user is given this information through an information displaying means such as a liquid crystal panel (Step 604); as the controller 11 detects, through the detecting portion 21 that the developer in the black developer cartridge 1 has been consumed virtually in entirety, it displays on the display 101 that the black developer cartridge 1 needs to be replaced.

The apparatus main assembly 100 has multiple (four in this embodiment) developer cartridge chambers 16, which are independent from each other, and each of which has a door 2 which can be independently opened or closed from the other doors 2. More specifically, the apparatus main assembly 100 has a door 2K for a black developer cartridge chamber 16K, a door 2C for a cyan developer cartridge chamber 16C, a door 2M for a magenta developer cartridge chamber 16M, and a door 2Y for a yellow developer cartridge chamber 16Y. The apparatus main assembly 100 is also provided with multiple (four in this embodiment) door locking apparatuses 10 which are means for keeping the developer cartridge chamber doors 2 locked, one-for-one. Next, referring to FIG. 3, each of the developer cartridge chamber doors 2 is provided with a hook 2*a*, whereas the apparatus main assembly 100 is provided with multiple latches 3 (one for each hook 2*a*), which engage with the hook 2*a* of the door 2. The latches 3, which are door locking means, are rotationally supported by bearings 4 (FIG. 4), one-for-one, with which the apparatus main assembly 100 is provided. Each latch 3 keeps the corresponding developer cartridge chamber door 2, that is, the first door, locked. The latch 3 is under the pressure from a spring 5 (FIG. 4), which works in the direction to rotate the latch 3 as indicated by an arrow mark in FIG. 4. Thus, the latch 3 remains in the locking position shown in FIG. 4. Further, the apparatus main assembly 100 is provided with multiple (four in this embodiment) solenoids 6 and multiple (four in this embodiment) linkages 7. Each solenoid 6 is attached to a specific portion of the apparatus main assembly 100, and functions as a part of a door controlling mechanism. The linkage 7 is in connection with the solenoid 6, and is slid by the solenoid 6 in the direction indicated by an arrow mark B in FIG. 4. As the solenoid 6 is turned on by the controller 11, the linkage 7 is slid against the resiliency of a return spring 8, and presses on the end portion of the latch 3, causing the latch 3 to rotate against the resiliency of the spring 5 in the direction to disengage from the hook 2*a* of the door 2. Consequently, the latch 3 disengages from the hook 2*a*, allowing thereby the developer cartridge chamber door 2 to open. That is, in this embodiment, the locking apparatus 10, which is a door locking means, is in engagement with the developer cartridge chamber door 2, and is moved by the solenoid 6 which keeps the door 2 closed unless it is activated. The developer cartridge chamber door 2 is always under the pressure applied thereto from an unshown pressure applying means in the direction to open the door 2. Therefore, as the latch 3 is disengaged from the hook 2*a*, the developer cartridge chamber door 2 automatically opens. However, the image forming apparatus main assembly 100 is provided with the external door 102, that is, the second door, which is large enough to cover all the multiple developer cartridge chamber doors 2. Therefore, while the external door 102 remains closed, the developer cartridge chamber doors 2 are kept closed by the external door 102. Incidentally, the means for keeping the developer cartridge chamber door 2 pressed in the opening direction, may be structured to utilize the weight of the door itself, or to employ a pressure applying means such as a spring (Step 605).

The controller 11 determines, based on the information sent from the developer amount detecting portion 21, whether or not the amount of the developer in the developer cartridge 1 is greater than a preset value, that is, whether or not it is unnecessary to replace the developer cartridge 1. If the controller 11 determines that it is unnecessary to replace the developer cartridge 1, it keeps the developer cartridge chamber door 2 locked by the locking apparatus 10 as a locking means, preventing the door 2 from opening regardless whether the external door 102 is open or closed. On the other hand, if it determines based on the information from the developer amount detecting portion 21 that the developer in the developer cartridge has been consumed virtually in entirety, it unlocks only the developer cartridge chamber door 2 which corresponds to the developer cartridge 1, with the use of the locking apparatus 10, which also corresponds to this developer cartridge 1. That is, the controller 11 controls the latch 3, which is a locking means, based on the amount of the developer in the developer cartridge 1, which is detected by the developer amount detecting portion 21, which is the means for detecting the amount of developer remaining in the developer cartridge 1; the controller 11 controls the latch 3 so that it unlocks (unlatches) only the developer cartridge chamber door 2, that is, the first door, which corresponds to the developer cartridge 1, that is, the cartridge which needs to be replaced, among multiple developer cartridges in the apparatus main assembly 100. As for the solenoid 6 which is the locking mechanism moving means, it causes the latch 3 which is a locking means, to unlatch from the hook 2*a* of the developer container slot door 2 which is the first door, allowing the door 2 to move from its closed position, to its open position.

Then, the user is to open the external door 102 following the instruction given by the above-mentioned display 101. As the user opens the external door 102 (Step 606), the developer cartridge chamber door 2 automatically opens (Step 607). In other words, as the external door 102 is opened, the developer cartridge chamber door 2 which corresponds to the developer cartridge 1 to be replaced, automatically opens, making it possible for the development cartridge 1 to be replaced. The controller 11 detects, through the door position detecting means 9 for detecting the position of the developer cartridge chamber door 2 shown in FIG. 3, that the developer cartridge chamber door 2 is open (Step 608), and turns off the solenoid 6. Thus, the linkage 7 is slid back by the return spring 8, being thereby separated from the end portion of the latch 3. Thus, the latch 3 returns to the door locking position by being rotated by the spring 5 in the direction indicated by an arrow mark A in FIG. 4 (Step 609).

As the developer cartridge chamber door 2 is allowed to automatically open, by the opening of the external door 102 which is initiated by the user, the user is to remove the development cartridge 1 in the development cartridge chamber in the apparatus main assembly 100, and insert a new developer cartridge (1) into the chamber (Step 610). Then, the user is to close the developer cartridge chamber door 2 (Step 611). Then, the user is to close the external door 102 (Step 612). As the developer cartridge chamber door 2 is closed (rotationally moved), the hook 2*a* of the door 2 causes the latch 3, which is in the locking position, to rotate against the resiliency of the spring 5. As the developer cartridge chamber door 2 is rotated far enough to place its hook 2*a* in the locking (hooking) position, the latch 3 is moved back into its locking position by the resiliency of the spring 5, and engages with the hook 2*a*, making thereby it impossible for the developer cartridge chamber door 2 to open (FIG. 5).

Incidentally, even if an attempt is made to open the other developer cartridge chamber doors 2, which did not open when the external door 102 was opened, the corresponding latches 3 and hooks 2*a* remain locked with each other. Therefore, these doors 2 cannot be opened. Further, not only is the apparatus main assembly 100 structured to allow only the developer cartridge chamber door 2 which corresponds the developer cartridge 1, that is, the cartridge which needs to be replaced, to automatically open, but also, the developer cartridge chamber doors 2 are not provided with a knob or handle, that is, a portion to grasp to open the doors 2, to visually indicate that the developer cartridges behind these doors 2 cannot be replaced.

As the developer cartridge chamber door 2 is closed, the door position detecting means 9 detects that the developer cartridge chamber door 2 is in the closed position (Step 613). As soon as it is detected that the developer cartridge chamber door 2 has been moved back into its closed position, the apparatus main assembly 100 begins to supply its developer hopper (unshown) with the developer from the developer cartridge 1, with the use of the unshown developer discharging means, becoming ready again for printing (Step 614).

The apparatus main assembly 100 is structured as described above. Thus, when there remains a sufficient amount of developer in the development cartridge 1, that is, when the development cartridge 1 does not need to be replaced, the developer cartridge chamber door 2 which corresponds to this development cartridge 1 remains locked, being therefore prevented from automatically opening. On the other hand, as the development cartridge 1 reduces in the amount of the developer therein, that is, as it becomes necessary for the development cartridge 1 to be replaced, the controller 11 makes it possible for only the developer cartridge chamber door 2 which corresponds to the developer cartridge 1 to automatically open. Therefore, it is possible to prevented the problem that a development cartridge (1) which does not need to be replaced is erroneously replaced by a user.

Figure 7:
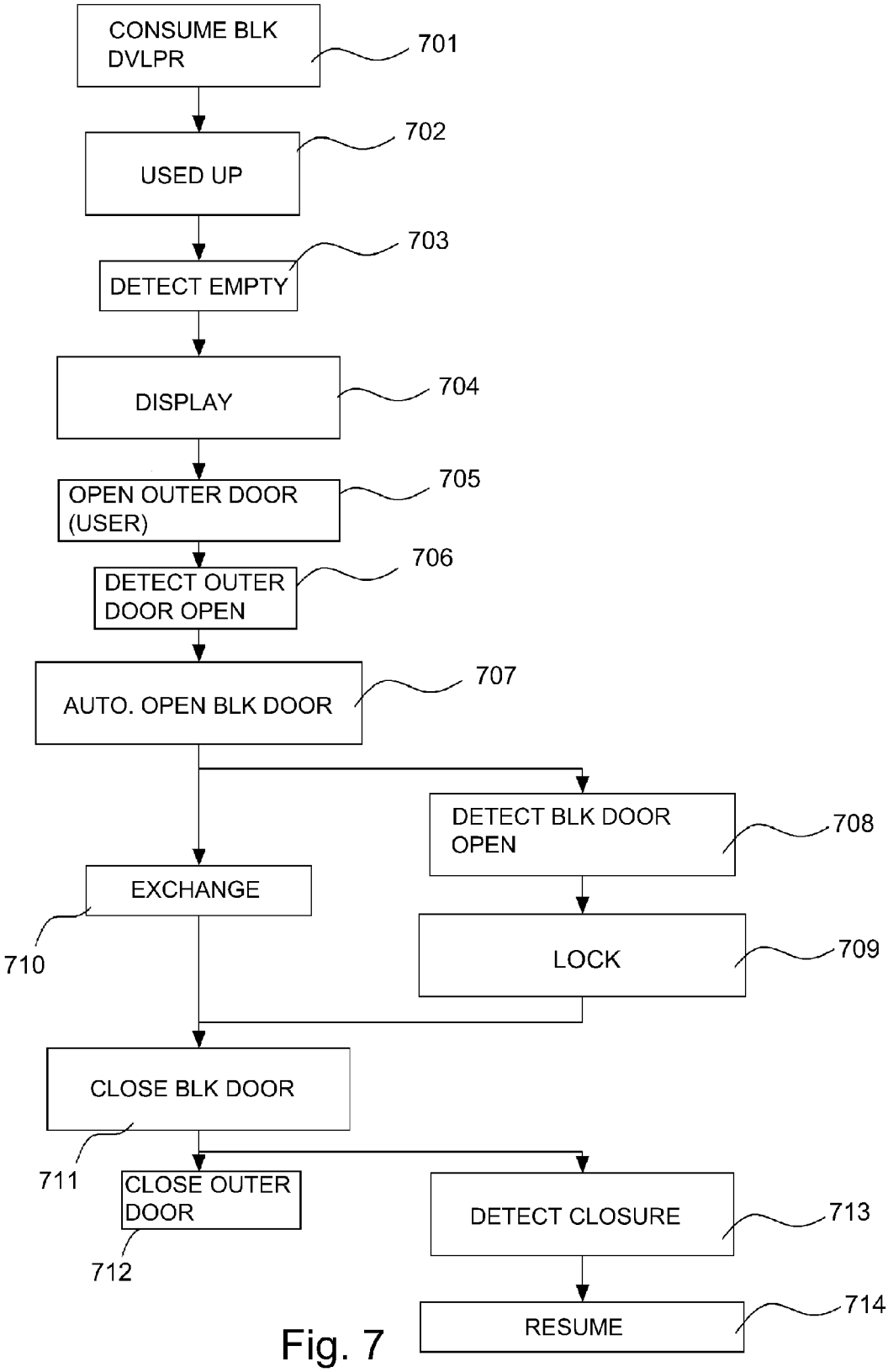
FIG. 7 is a flowchart of the development cartridge replacement sequence of the image forming apparatus, whose development cartridge chambers doors are equipped with a means for detecting whether the external door is open or closed.
Figure 9:
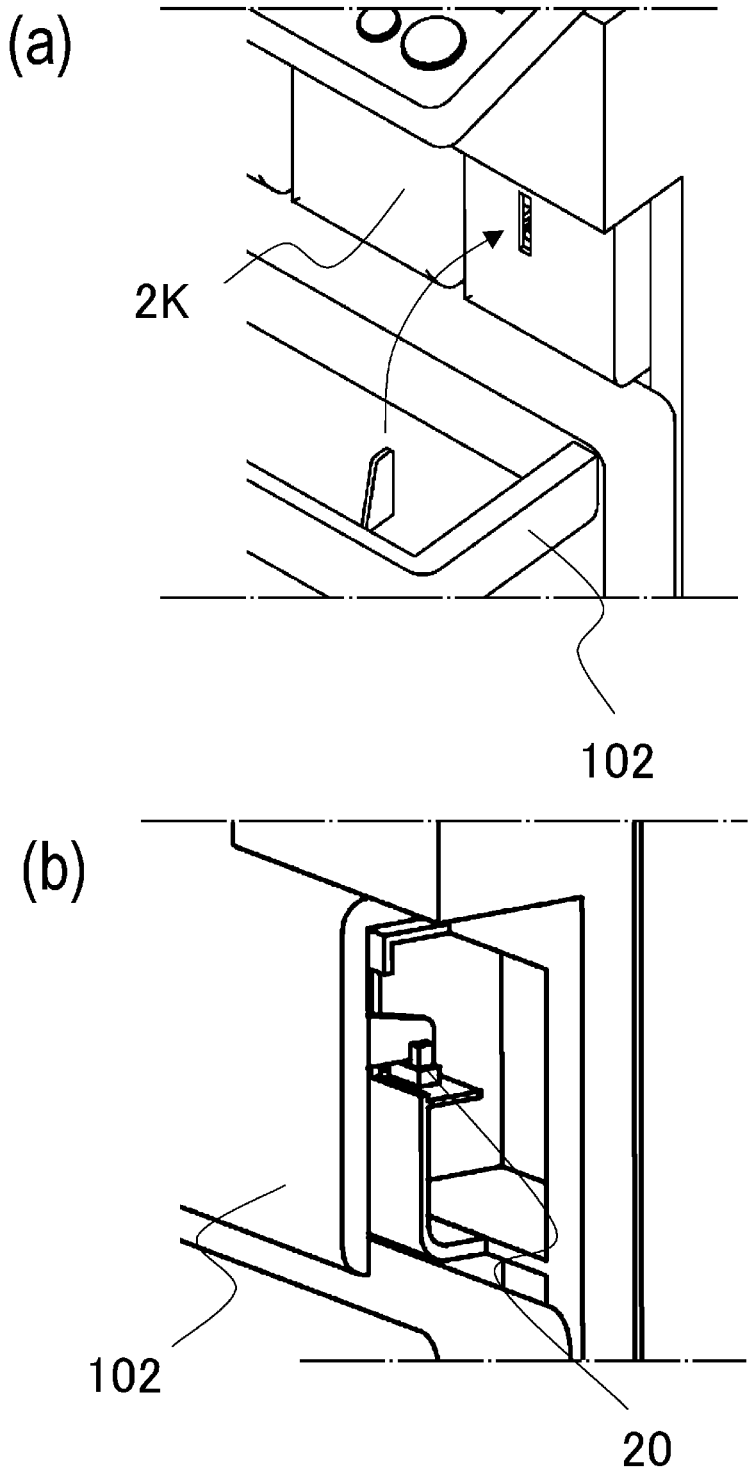
FIG. 9 is a perspective view of the means for detecting whether the external door is open or closed.

In the embodiment described above, the apparatus main assembly 100 is structured so that the developer cartridge chamber door locking apparatus 10 was enabled to unlock (or lock) each of the multiple (four in this embodiment) developer cartridge chamber doors 2, independently from the other, based on the information (amount of remaining developer) detected by the developer amount detecting portion 21. However, the same effects as those achievable by the above described embodiment can also be achieved by providing the apparatus main assembly 100 with a door position detecting means 20, shown in FIG. 9, which functions as a means for detecting whether the external door 102 is in the open or closed position. Incidentally, the door 2K in FIG. 9 is the door of the black toner cartridge chamber. FIG. 7 shows the flowchart of the developer cartridge replacement sequence for this apparatus main assembly 100. The image forming apparatus main assembly 100 whose developer cartridge replacement sequence flowchart is shown in FIG. 7 is advantageous over the image forming apparatus main assembly 100 whose developer cartridge replacement sequence flowchart is shown in FIG. 6, in that the developer cartridge chamber doors 2 of the former do not collide with the external door 102, and therefore, do not generate collisional noises.

Next, the development cartridge replacement sequence carried out by the developer supplying apparatus 12 in this apparatus main assembly 100 will be described with reference to the replacement of the developer cartridge 1. As an electrophotographic image formation process is continued by the image forming apparatus main assembly 100 (Step 702), the developer in the developer cartridge 1 is eventually consumed virtually in entirety (Step 702). As the developer in the developer cartridge 1 is consumed virtually in entirety, the state of the developer cartridge 1, in terms of the amount of the developer therein, is detected by a developer amount detecting portion 21, which is a means for detecting the amount of the developer in a developer cartridge, and is in the image forming apparatus main assembly 100; it is detected that the developer cartridge 1 has run out of developer (Step 703). Then, a user is given this information through an information displaying means such as a liquid crystal panel (Step 704); as the controller 11 detects, through the detecting portion 21 that the developer in the developer cartridge 1 has been consumed virtually in entirety, it displays on the display 101 that the developer cartridge 1 needs to be replaced. As the user opens the external door 102 following the instruction given by the display (Step 705), and it is detected, by the door position detecting means 20 for detecting whether or not the external door 102 is open, that the external door 102 is open (Step 706), the controller 11 unlocks the developer cartridge chamber door 2, allowing thereby the developer cartridge chamber door 2 to automatically open (Step 707).

That is, in this embodiment, the apparatus main assembly 100 is provided with the means 20 for detecting whether or not the external door 102 is open. Thus, as it is detected by the developer amount detecting portion 21 that the developer in the developer cartridge 1 has just been consumed virtually in entirety, and also, it is detected by the external door position detecting means 20 that the external door 102 is in the open position, the controller 11 causes the locking apparatus 10 to unlock only the developer cartridge chamber door 2 which corresponds to this developer cartridge 1, allowing the door 2 to automatically open to make it possible for the developer cartridge 1 to be replaced.

The controller 11 detects, through the door position detecting means 9 for detecting the position of the developer cartridge chamber door 2 shown in FIG. 3, that the developer cartridge chamber door 2 is open (Step 708), and turns off the solenoid 6. Thus, the linkage 7 is slid back by the return spring 8, being thereby separated from the end portion of the latch 3. Thus, the latch 3 is rotated by the spring 5 in the direction indicated by an arrow mark A in FIG. 4, returning thereby to the door locking position (Step 709).

Then, the user is to remove the development cartridge 1 in the development cartridge chamber in the apparatus main assembly 100, insert a new developer cartridge (1) into the developer cartridge chamber (Step 710), close the developer cartridge chamber door 2 (Step 711), and then, close the external door 102 (Step 712). As the developer cartridge chamber door 2 is closed (rotationally moved), the hook 2*a* of the door 2 causes the latch 3, which is in the locking position, to rotate against the resiliency of the spring 5. As the developer cartridge chamber door 2 is rotated far enough to place its hook 2*a* in the locking position, the latch 3 is moved back into its locking position by the resiliency of the spring 5, and engages with the hook 2*a*, making it thereby impossible for the developer cartridge chamber door 2 to open (FIG. 5).

As the developer cartridge chamber door 2 is closed, the door position detecting means 9 detects that the developer cartridge chamber door 2 is in the closed position (Step 713). As soon as it is detected that the developer cartridge chamber door 2 has been moved back into its closed position, the apparatus main assembly 100 begins to supply its developer hopper (unshown) with the developer from the developer cartridge 1, with the use of the unshown developer discharging means, becoming thereby ready again for printing (Step 714). That is, the apparatus main assembly 100 in this embodiment has the door position detecting means 20 for detecting whether or not the external door 102 (second door) is open. The controller 11 unlocks the pertinent developer cartridge chamber door 2 (first door) after it detects, based on the information from the door position detecting means 20, that the external door 102 is open.

In this embodiment, the solenoid 6 is used as the means for causing the locking apparatus 10 to unlock the developer cartridge chamber doors 2. However, this embodiment is not intended to limit the present invention in terms of the method for driving the locking apparatus 10. For example, the image forming apparatus main assembly 100 may be structured so that the locking apparatus 10 is driven by a rotational driving means which engages with the developer cartridge chamber door 2 to prevent the door 2 from opening. The effects of the structural arrangement that employs the rotational driving means to disengage the latch 3 and hook 2*a* from each other are the same as those obtainable with the structural arrangement which employs the solenoid 6. In other words, the present invention is also applicable to an image forming apparatus which employs a rotational driving means to disengage its latch 3 and hook 2*a* from each other, which is obvious.

In this embodiment, the developer cartridge chamber doors 2 and external door 102 are different from the door 103 for removing jammed recording medium or the like, and the maintenance door 104 for image forming portions, which are shown in FIGS. 1 and 2. Therefore, it is unnecessary to open these doors 103 and 104 to replace any of the multiple developer cartridges in the apparatus main assembly 100, and therefore, it is unnecessary to interrupt an on-going black-and-white image forming operation to replace any of the multiple developer cartridges other than the black developer cartridge in the apparatus main assembly 100. In other words, even when it is detected that one of the developer cartridges 1 other than the black developer cartridge 1, is virtually out of developer, and therefore, is replaced by a user by opening the external door 102, the formation of images with the use of black developer, and the outputting of the black-and-white prints, can be continued.

That is, even if it is detected by the developer amount detecting portion 21 that at least one of the multiple developer cartridges 1 other than the black developer cartridge 1 is virtually out of developer, and therefore, a user opens the external door 102, and replaces the developer cartridge 1 which is virtually out of developer, the image forming apparatus 100 does not stop the on-going image forming operation, as long as the on-going image forming operation uses only the black developer.

Further, the apparatus main assembly 100 is provided with the developer hopper (unshown) of a large capacity, in which the developer is stored for immediate consumption. Thus, the image forming apparatus main assembly 100 is enabled to carry out a printing operation even while the developer cartridge(s) 1 is replaced by opening the external door 102. That is, the developer cartridge(s) 1 can be replaced even while the apparatus main assembly 100 is forming images. Incidentally, even if an image forming apparatus is provided with a developer hopper of a large capacity, the image forming apparatus will stop the on-going image forming operation as soon as the developer hopper runs out of developer, which is obvious.

Referring to FIG. 2, in this embodiment, one of the lateral walls of the image forming apparatus main assembly 100 is provided with the developer cartridge chamber doors 2 and external door 102 so that the developer cartridges 1 are to be inserted into, or pulled out of, the apparatus main assembly 100, in the side-to-side direction (from front side of drawing to rear side in FIG. 2). Further, the developer cartridge chamber doors 2 are not provided with a knob, a handle, or the like.

The present invention is applicable to any image forming apparatus, such as a printer, a copy machine, a facsimile machine, etc., which is structured to employ replaceable developer cartridges.

The present invention makes it possible to provide an image forming apparatus which does not have multiple displays which correspond to multiple developer cartridges, one-for-one, and yet, enables an operator to easily find a developer cartridge, in the apparatus, which needs to be replaced, and also, is structured so that it does not occur that a developer cartridge chamber door opens without a confirmation from a user, and therefore, is left open in the state in which the corresponding cartridge is accessible.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 207865/2009 filed Sep. 9, 2009 which is hereby incorporated by reference.

What is claimed is:

1. An image forming apparatus comprising:

an image forming portion including a plurality of image bearing members for carrying images and a plurality of developing devices for developing latent images formed on respective said image bearing members;

a plurality of cartridges, detachably mountable to a main assembly of said apparatus, for supplying developers to respective said developing devices;

a maintenance door for allowing access to said image forming portion for a maintenance operation;

a plurality of first doors capable of opening and closing respective openings for insertion of said cartridges into the main assembly independently from each other, without access via said maintenance door;

remainder detecting means for detecting information relating to amounts of the developers in respective said cartridges;

locking means for locking said first doors;

a controller capable of controlling said locking means to release a locking of a first door out of said first doors that corresponds to a cartridge out of said cartridges which requires exchange, on the basis of a detection result of said remainder detecting means;

a moving mechanism for moving said released first door from a closed position to an opened position; and a second door capable of opening and closing to cover said first doors, wherein an image forming operation is capable of continuing irrespective of an opening and closing operation of said first doors and said second door, and said controller controls said locking means so that when an operator opens said second door, only selected ones of said first doors, that are required to be open for an exchange of the respective cartridges, are opened.

2. An apparatus according to claim 1, further comprising opening and closing detecting means for detecting an opening and closing of said second door, wherein said controller releases the locking of the selected ones of said first doors after detection of an opening of said second door on the basis of a detection result of said remainder detecting means.

3. An apparatus according to claim 1, further comprising displaying means for displaying a necessity of an exchange of a cartridge on the basis of the detection result of said remainder detecting means.

4. An image forming apparatus comprising:

an image forming portion including a plurality of image bearing members for carrying images and a plurality of developing devices for developing latent images formed on respective said image bearing members;

a plurality of cartridges, detachably mountable to a main assembly of said apparatus, for supplying developers to respective said developing devices;

a maintenance door for allowing access to said image forming portion for a maintenance operation;

a plurality of first doors capable of opening and closing respective openings for insertion of said cartridges into the main assembly independently from each other, without access via said maintenance door;

remainder detecting means for detecting information relating to amounts of the developers in respective said cartridges;

locking means for locking said first doors;

a controller capable of controlling said locking means to release a locking of a first door out of said first doors that corresponds to a cartridge out of said cartridges which requires exchange, on the basis of a detection result of said remainder detecting means;

a moving mechanism for moving said released first door from a closed position to an opened position; and a second door capable of opening and closing to cover said first doors, wherein an image forming operation is capable of continuing irrespective of an opening and closing operation of said first doors and said second door, and said controller releases said locking of only a first door, out of said first doors, that requires to be opened for exchange of a cartridge.

* * * * *